US010281217B2

(12) United States Patent
Holmes et al.

(10) Patent No.: US 10,281,217 B2
(45) Date of Patent: May 7, 2019

(54) MULTIFLUID HEAT EXCHANGER

(71) Applicant: DENSO International America, Inc., Southfield, MI (US)

(72) Inventors: Mark Holmes, Troy, MI (US); Daniel Tylutki, Livonia, MI (US)

(73) Assignee: DENSO International America, Inc., Southfield, MI (US)

( * ) Notice: Subject to any disclaimer, the term of this patent is extended or adjusted under 35 U.S.C. 154(b) by 77 days.

(21) Appl. No.: 15/593,435

(22) Filed: May 12, 2017

(65) Prior Publication Data

US 2018/0328669 A1 Nov. 15, 2018

(51) Int. Cl.

| | |
|---|---|
| ***F28D 9/02*** | (2006.01) |
| ***F28D 1/04*** | (2006.01) |
| ***F28F 9/02*** | (2006.01) |
| ***F28D 1/053*** | (2006.01) |
| *F28D 21/00* | (2006.01) |

(52) U.S. Cl.

CPC ..... *F28D 1/0408* (2013.01); *F28D 1/05366* (2013.01); *F28F 9/0224* (2013.01); *F28D 2021/0089* (2013.01); *F28D 2021/0094* (2013.01); *F28F 9/0226* (2013.01); *F28F 2009/0287* (2013.01)

(58) Field of Classification Search

CPC ..... F28D 1/0408; F28F 9/0229; F28F 9/0234; F28F 9/0226

USPC ..... 165/140, 174, 175

See application file for complete search history.

(56) References Cited

U.S. PATENT DOCUMENTS

| | | | | |
|---|---|---|---|---|
| 1,955,433 | A * | 4/1934 | Miller | F28F 9/0239 165/158 |
| 2,382,255 | A * | 8/1945 | Pyzel | F28D 13/00 165/140 |
| 3,001,766 | A * | 9/1961 | Laist | F28D 7/0058 165/134.1 |
| 4,224,982 | A * | 9/1980 | Frei | F28F 9/0229 165/134.1 |
| 4,289,507 | A | 9/1981 | Cadars et al. | |
| 6,334,483 | B1 * | 1/2002 | Berglund et al. | C09C 1/50 165/134.1 |
| 7,806,169 | B2 * | 10/2010 | Yoshida et al. | A61M 1/1698 165/140 |
| 8,210,246 | B2 * | 7/2012 | Bhatti et al. | F28D 1/0426 165/140 |
| 2006/0096286 | A1 * | 5/2006 | Agee et al. | F02B 29/0456 60/599 |
| 2009/0008074 | A1 * | 1/2009 | Vamvakitis et al. | F28D 7/0083 165/177 |

(Continued)

FOREIGN PATENT DOCUMENTS

| | | | |
|---|---|---|---|
| JP | 2008-170140 | A | 7/2008 |
| JP | 2009-74739 | A | 4/2009 |
| WO | 2008-072730 | A1 | 6/2008 |

*Primary Examiner* — Allen J Flanigan

(57) ABSTRACT

A multifluid heat exchanger includes a first tank connected to a second tank through a plurality of fluid conduits. A partition disposed inside the first tank divides an internal space of the first tank into a first space and a second space. The first space is in fluid communication with the second tank through the plurality of fluid conduits. As a result, a first internal fluid may flow from the first space to the second tank, while a second internal fluid may flow through the second space.

17 Claims, 6 Drawing Sheets

(56) References Cited

U.S. PATENT DOCUMENTS

| | | | | |
|---|---|---|---|---|
| 2009/0018629 | A1* | 1/2009 | Yoshida et al. ..... | A61M 1/1698<br>607/113 |
| 2013/0192803 | A1* | 8/2013 | Garret et al. ..... | F28D 7/1684<br>165/151 |

* cited by examiner

MULTIFLUID HEAT EXCHANGER

TECHNICAL FIELD

The present disclosure relates to a multifluid heat exchanger for exchanging heat of multiple fluids.

BACKGROUND

Heat exchangers such as radiators for vehicles are known. For example, a typical radiator found in the engine compartments of vehicles may exchange heat between an internal fluid, such as radiator fluid, and an external fluid, such as air. In certain applications, it is desirable to exchange heat between multiple internal fluids and an external fluid. However, due to factors such as mounting space constraints, it may be unfeasible to provide multiple heat exchangers or otherwise mechanically complex heat exchangers. As such, an improved multifluid heat exchanger is desirable.

SUMMARY

According to one aspect of the present disclosure, a multifluid heat exchanger includes a first tank connected to a second tank through a plurality of fluid conduits. A partition disposed inside the first tank divides an internal space of the first tank into a first space and a second space. The first space is in fluid communication with the second tank through the plurality of fluid conduits. As a result, a first internal fluid may flow from the first space to the second tank, while a second internal fluid may flow through the second space.

Still other objects, advantages, and features of the present disclosure will become apparent after considering the detailed description and drawings.

DETAILED DESCRIPTION

First Embodiment

A first embodiment of the present disclosure will be explained with reference to FIGS. 1 to 5.

Figure 1:
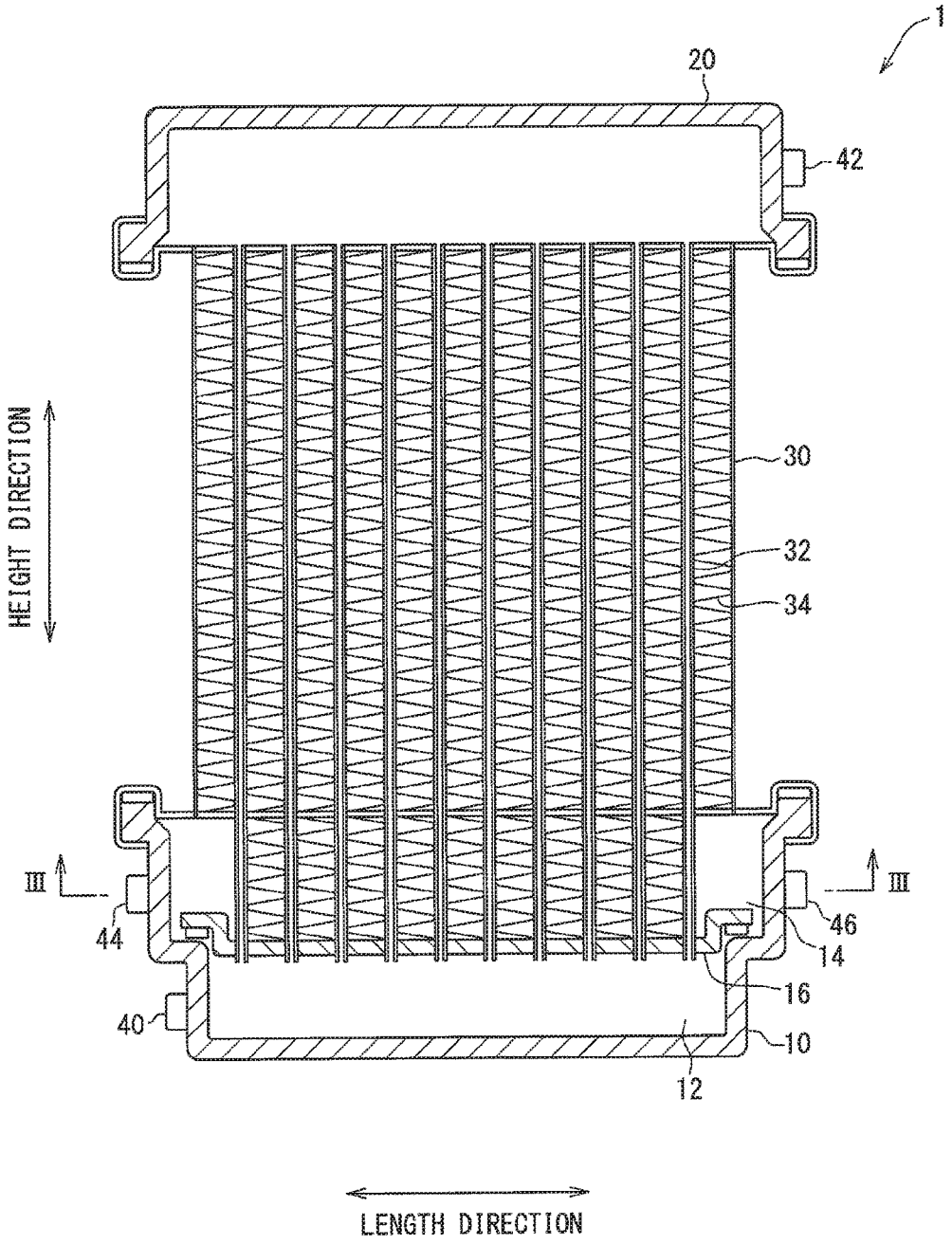
FIG. 1 a cross section view showing a multifluid heat exchanger.

FIG. 1 illustrates an overall view of a multifluid heat exchanger 1 according to the present embodiment. In FIG. 1, a length direction corresponds to the left-right direction, a height direction corresponds to the up-down direction, and a width direction corresponds to a direction orthogonal to both the length and height directions (i.e., the width direction corresponds to a direction into and out of the page).

The multifluid heat exchanger 1 is configured to transfer heat between a plurality of internal fluids and at least one external fluid. In other words, the term "multifluid" as used herein refers to a plurality of internal fluids of the multifluid heat exchanger 1. In the present embodiment, the multifluid heat exchanger 1 generally includes a first tank 10, a second tank 20, and a core 30. The first tank 10 is connected to the second tank 20 through the core 30, such that the first tank 10 is in fluid communication with the second tank 20.

Specifically, the core 30 includes a plurality of fluid conduits 32 which allow an internal fluid to flow between the first tank 10 and the second tank 20. The fluid conduits 32 may be, for example, hollow metal tubes with a flattened shape. The core 30 further includes a plurality of fins 34 disposed between adjacent ones of the fluid conduits 32. The fins 34 may be, for example, metal plates formed of a material with high heat conductivity. The fins 34 serve to promote heat exchange between an internal fluid flowing inside the fluid conduits 32 and an external fluid flowing outside past the fluid conduits 32. As such, the fins 34 are preferably oriented to be parallel to the flow direction of this external fluid, i.e., in a direction orthogonal to an extension direction of the fluid conduits 32. In the example of FIG. 1, the multifluid heat exchanger 1 is designed to allow air to flow in a direction substantially coinciding with the width direction (i.e., into and out of the page). Accordingly, in this example, the fins 34 are oriented to extend in the width direction.

The internal space of the first tank 10 is divided into a first space 12 and a second space 14 by a partition 16 disposed inside the first tank 10. The partition 16 may be, for example, a metal plate.

The first space 12 is separated from the second space 14 in a liquid tight manner by the partition 16. The first space 12 is configured to carry a first internal fluid. The first internal fluid may be, for example, radiator fluid, water, engine oil, liquid coolant, gaseous coolant, or other types of fluids to be heated or cooled. A first fluid port 40 is provided on the first space 12 to allow the first internal fluid to enter or exit the first space 12. As shown in FIG. 1, the fluid conduits 32 of the core 30 extend through the partition 16 to open into the first space 12. In other words, within the first tank 10, only the first space 12 is in fluid communication with the fluid conduits 32. The first internal fluid in the first space 12 is able to flow into or out of the fluid conduits 32 to enter or exit the second tank 20. As such, the second tank 20 is also configured to carry the first internal fluid. A second fluid port 42 is provided on the second tank 20 to allow the first internal fluid to enter or exit the second tank 20.

The second space 14 is configured to carry a second internal fluid. The second internal fluid may be, for example, radiator fluid, water, engine oil, liquid coolant, gaseous coolant, or other types of fluids to be heated or cooled. A third fluid port 44 and a fourth fluid port 46 are provided on the second space 14 to allow the second internal fluid to enter and exit the second space 14. As shown in FIG. 1, the fluid conduits 32 of the core 30 pass entirely through the second space 14. Accordingly, the second internal fluid in the second space 14 is prohibited from entering the fluid conduits 32. Thus, the second internal fluid only flows through the second space 14, i.e., either entering from the third fluid port 44 to exit through the fourth fluid port 46, or entering from the fourth fluid port 46 to exit through the third fluid port 44. In the present embodiment, the fins 34 are provided at the portion of the fluid conduits 32 passing through the second space 14. In other words, the fins 34 are also disposed within the second space 14.

Figure 2:
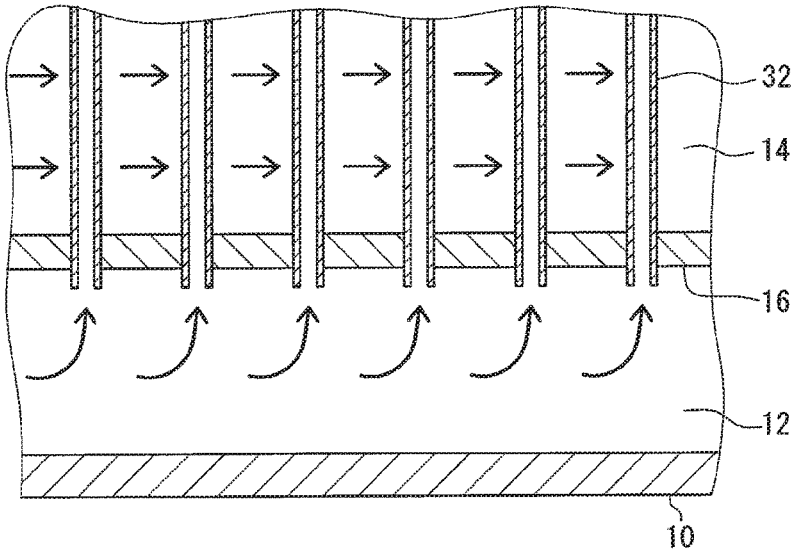
FIG. 2 is a sectional view showing fluid flow in a multifluid heat exchanger.

FIG. 2 shows an example of fluid flow in the first space 12 and the second space 14. In FIG. 2, the fins 34 are omitted from illustration for clarity. In this example, the first internal fluid in the first space 12 is flowing from left to right, and flows into the fluid conduits 32 to eventually reach the second tank 20 (not illustrated in FIG. 2). The second internal fluid in the second space 14 is also flowing from left to right, but simply flows past the fluid conduits 32. It should be emphasized that the directions of flow in FIG. 2 are exemplary in nature and not limiting, as will be described in detail later.

Figure 3:
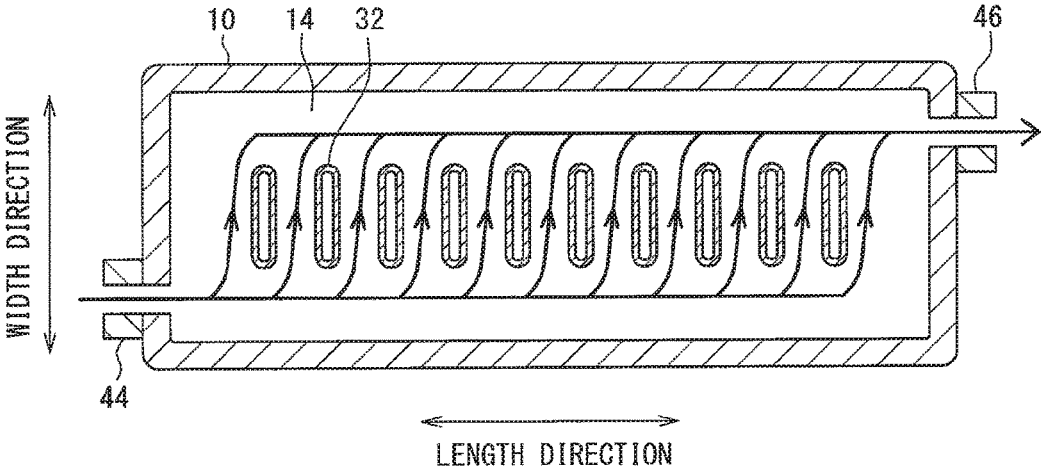
FIG. 3 is a cross section view along line III of FIG. 1, and shows fluid flow in a multifluid heat exchanger.

FIG. 3 is a cross section view along line III of FIG. 1. As such, in FIG. 3, the width direction corresponds to the up-down direction, while the length direction corresponds to the left-right direction. As shown in FIG. 3, the third fluid port 44 is offset from the fourth fluid port 46 along the width direction of the second space 14. That is, the third fluid port 44 is closer toward one side in the width direction, while the fourth fluid port 46 is closer toward the opposite side in the width direction. As a result, the second internal fluid is forced to flow past the fluid conduits 32 in both the length and width directions when passing through the second space 14.

In the example of FIG. 3, the second internal fluid enters through the third fluid port 44, flows past the fluid conduits 32, and exit out of the fourth fluid port 46. As a result of flowing past the fluid conduits 32 in both the length and width directions, the second internal fluid also flows past the fins 34 (not shown in FIG. 3 for clarity) disposed between the fluid conduits 32. As described previously, the fins 34 are preferably oriented to extend along the width direction. When the second internal fluid flows past the fins 34 in this manner, the fins 34 promote heat exchange between the first internal fluid (which is inside the fluid conduits 32) and the second internal fluid (which is outside of the fluid conduits 32).

As a result of the above described configuration, heat may be efficiently exchanged between the first internal fluid and the second internal fluid.

In particular, heat exchange is first conducted between the first internal fluid and the second internal fluid by the partition 16. Since the partition 16 is disposed along the entire internal space of the first tank 10, the partition 16 has a large surface area and may efficiently exchange heat between the first internal fluid and the second internal fluid along the entire length of the first tank 10.

Furthermore, additional heat exchange is promoted as the second internal fluid in the second space 14 flows past the fluid conduits 32 and fins 34 inside the second space 14. As shown in FIGS. 2 and 3, the second internal fluid is forced past the fluid conduits 32 along both the width and length directions. At the same time, the first internal fluid is flowing inside the fluid conduits 32. As result, heat may be efficiently exchanged between the first internal fluid and the second internal fluid, and this heat exchange is further promoted by providing the fins 34 between the fluid conduits 32 within the second space 14. Moreover, since the fluid conduits 32 and the fins 34 are provided substantially along the entire length of the second space 14, a relatively significant amount of heat may be exchanged.

As described previously, the multifluid heat exchanger 1 is configured to exchange heat between the first internal fluid, the second internal fluid, and at least one external fluid (such as air). However, the multifluid heat exchanger 1 is not limited to any specific directions of heat transfer. For example, the multifluid heat exchanger 1 may heat or cool the first internal fluid, and may also heat or cool the second internal fluid. The direction of heat transfer may be set as appropriate by setting the flow directions of the first and second internal fluids, as well as setting the temperature of the external fluid.

Figure 4A:
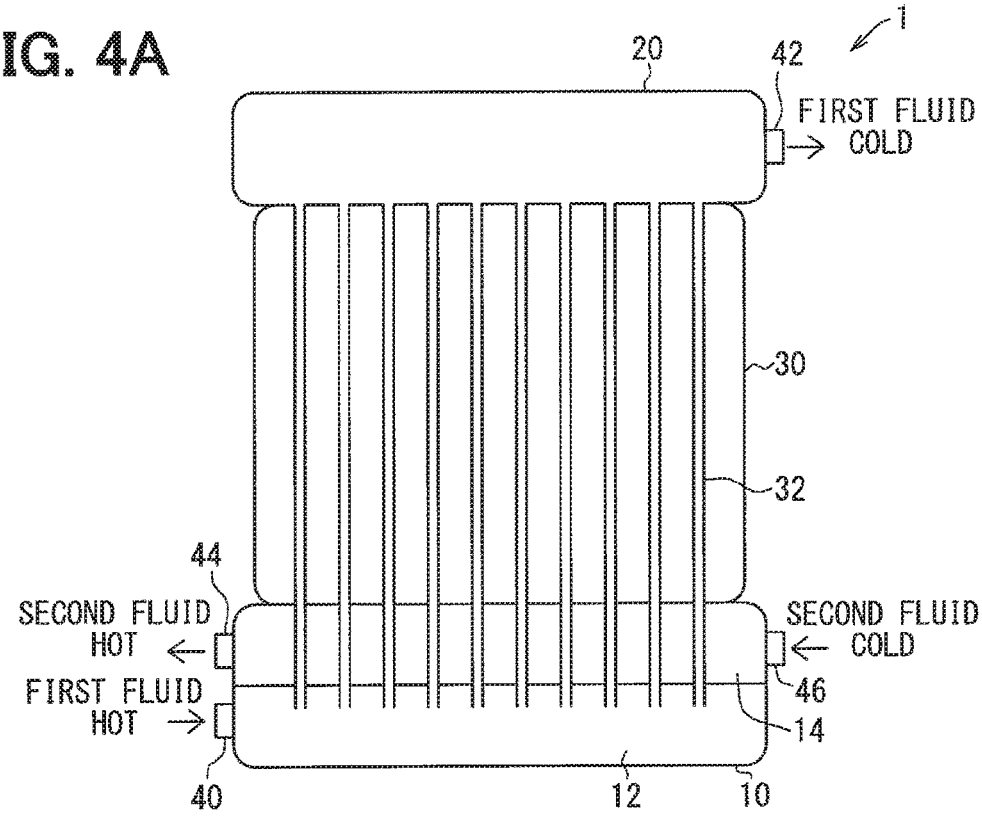
FIG. 4A is a schematic view showing heat exchange in a multifluid heat exchanger.
Figure 4B:
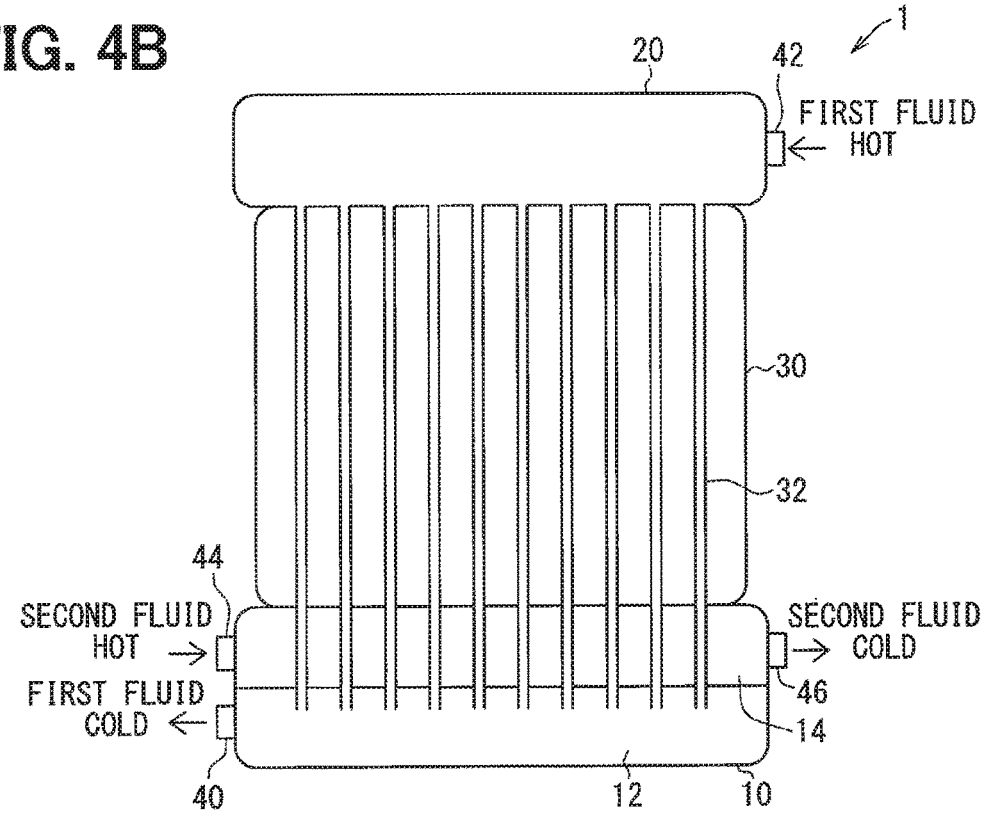
FIG. 4B is a schematic view showing heat exchange in a multifluid heat exchanger.

FIGS. 4A and 4B show two examples of heat exchange between the first internal fluid, the second internal fluid, and air. In these examples, it is assumed that cool air flows past the core 30 in the width direction (i.e., into and out of the page).

It should be emphasized that the terms "cooled", "heated", "hot", and "cold" as used herein are intended to be relative terms with no specifically defined temperature values or ranges. Moreover, the relative temperature between the first internal fluid and the second internal fluid is not intended to be limited. In other words, a "hot" temperature of the first internal fluid is higher than a "cold" temperature of the first internal fluid. However, the "cold" temperature of the first internal fluid may nevertheless be higher than the "hot" temperature of the second internal fluid.

FIG. 4A shows an example where the first internal fluid is cooled, while the second internal fluid is heated. Specifically, the first internal fluid enters through the first fluid port 40 into the first space 12 while hot. As the first internal fluid flows through the first space 12, the first internal fluid is heat exchanged with the second internal fluid through the partition 16. Then, the first internal fluid enters the fluid conduits 32 from the first space 12. As the first internal fluid within the fluid conduits 32 passes through the second space 14, the first internal fluid is again heat exchanged with the second internal fluid flowing in the second space 14. Then, the first internal fluid passes through the remaining portion of the fluid conduits 32 and is heat exchanged with cool air flowing through the core 30. Finally, the first internal fluid enters the second tank 20 and exist the second tank 20 through the second fluid port 42. The first internal fluid at the second fluid port 42 is cold, i.e., the first internal fluid is cooled.

Meanwhile, the second internal fluid enters the fourth fluid port 46 while cold. The second internal fluid flows through the second space 14 and is heat exchanged with the hot first internal fluid. As described above, this heat exchange is facilitated through the partition 16, and through the fluid conduits 32 and fins 34 disposed within the second space 14. As a result of this heat exchange, the second internal fluid exits at the third fluid port 44 and is hot at this point. Thus, the second internal fluid is heated.

FIG. 4B shows a different example where the first internal fluid is cooled, and the second internal fluid is also cooled. Specifically, the first internal fluid enters through the second fluid port 42 into the second tank 20 while hot. Then, the first internal fluid enters the fluid conduits 32 from the second tank 20. As the first internal fluid passes through the portion of the fluid conduits 32 outside of the second space 14, the first internal fluid is heat exchanged with cool air flowing through the core 30. Then, the first internal fluid within the fluid conduits 32 passes through the second space 14, and the first internal fluid is heat exchanged with the second internal fluid flowing in the second space 14. Next, the first internal fluid enters the first space 12 and flows toward the first fluid port 40. During this time as well, the first internal fluid is heat exchanged with the second internal fluid through the partition 16. Finally, the first internal fluid exits the first space 12 through the first fluid port 40. The first internal fluid at the second fluid port 42 is cold, i.e., the first internal fluid is cooled.

Meanwhile, the second internal fluid enters the third fluid port 44 while hot. The second internal fluid flows through the second space 14 and is heat exchanged with the hot first internal fluid. As described above, this heat exchange is facilitated through the partition 16, and through the fluid conduits 32 and fins 34 disposed within the second space 14. As a result of this heat exchange, the second internal fluid exits at the fourth fluid port 46 and is cold at this point. Thus, the second internal fluid is cooled.

As illustrated by the examples of FIGS. 4A and 4B, the multifluid heat exchanger 1 may exchange heat between the plurality of internal fluids and at least one external fluid in a variety of manners. These examples are not limiting and additional configurations of fluid flow are contemplated. For examples, in FIGS. 4A and 4B, the first internal fluid is counter flowed with respect to the second internal fluid, i.e., the first and second internal fluids flow in opposite directions along the length direction. However, the flow directions of the first and second internal fluids may be set as appropriate, and may flow in the same direction along the length direction. Further, in the examples of FIGS. 4A and 4B, the external fluid is assumed to be cool air. However, depending on the desired application, a hot external fluid may be used. For example, a heater (not illustrated) may be positioned in front of the multifluid heat exchanger 1 such that hot air flows past the fluid conduits 32. In such a case, the first internal fluid would be heated, while the second internal fluid may be heated or cooled depending on flow direction.

According to the above described configurations of the multifluid heat exchanger 1, heat exchange between the first internal fluid and the second internal fluid is promoted through both the partition 16, and through the fluid conduits 32 and fins 34 disposed within the second space 14. Moreover, the partition 16 extends across the entire length of the first tank 10, while the fluid conduits 32 and fins 34 are disposed between the third fluid port 44 and the fourth fluid port 46 substantially along the entire length of the second space 14. As a result, a relatively large amount of heat may be exchanged between the first internal fluid and the second internal fluid. In addition, all of the plurality of fluid conduits 32 are used to exchange heat between the first internal fluid and an external fluid. Accordingly, the heat exchange capabilities of the multifluid heat exchanger 1 with respect to the first internal fluid are maintained.

In addition, the multifluid heat exchanger 1 is able to promote heat exchange between the first and second internal fluids while being space efficient and simple in construction.

Figure 5A:
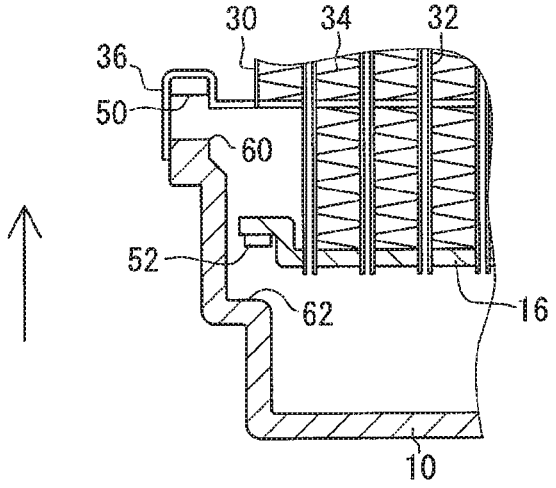
FIG. 5A shows a multifluid heat exchanger prior to assembly.
Figure 5B:
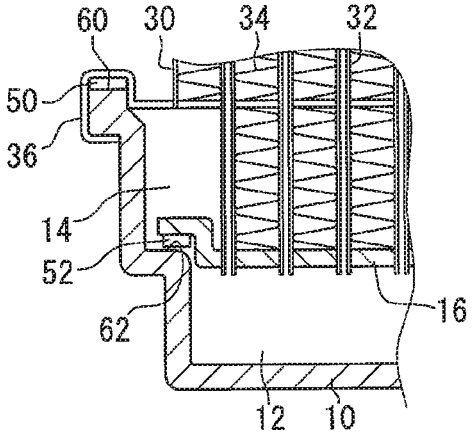
FIG. 5B shows a multifluid heat exchanger after assembly.

FIGS. 5A and 5B illustrate an exemplary method of assembling the first tank 10 with the core 30. As shown in FIG. 5A, prior to assembly, the core 30 includes a crimp end 36 which extends past the end face of the first tank 10 in the length direction. The partition 16 is secured to the core 30, with the fluid conduits 32 extending through the partition 16. The first tank 10 includes a first pressing portion 60 that corresponds to the crimp end 36, and a second pressing portion 62 that corresponds to the partition 16. As illustrated, in the present embodiment, the second pressing portion 62 is formed as a bend in the wall of the first tank 10.

Prior to assembling the first tank 10, a first gasket member 50 is positioned between the first pressing portion 60 and the crimp end 36, while a second gasket member 52 is positioned between the second pressing portion 62 and the partition 16. During assembly, the first tank 10 is pressed toward the core 30 and the partition 16. As a result, as shown in FIG. 5B, the first gasket member 50 is compressed between the first pressing portion 60 and the crimp end 36, while the second gasket member 52 is compressed between the second pressing portion 62 and the partition 16. Then, the crimp end 36 of the core 30 is crimped around the first pressing portion 60. The first gasket member 50 forms a liquid tight seal between the core 30 and the first tank 10, while the second gasket member 52 (together with the partition 16) forms a liquid tight seal between the first space 12 and the second space 14.

In this regard, the multifluid heat exchanger 1 may be assembled in a similarly simple manner as conventional heat exchangers, because only a single crimping operation (for each end of the first tank 10) is required. It should be emphasized that the assembly means and method shown in FIGS. 5A and 5B are exemplary in nature, and a variety of modifications are contemplated. For example, the first tank 10 may be simply welded onto the core 30, and similarly the partition 16 may be simply welded inside the first tank 10. In this case, the first and second gasket members 50 and 52 may still be provided, or may be removed in favor of the weld connection.

Second Embodiment

A second embodiment of the present disclosure will be described with reference to FIG. 6. Explanations with respect to elements which are identical or otherwise corresponding to those of the previous embodiment will be omitted for brevity.

In the present embodiment, a baffle 18 is provided in the second space 14. The baffle 18 is configured to regulate the flow of the second internal fluid within the second space 14. The baffle 18 may be, for example, a metal plate. As shown in FIG. 6, the baffle 18 is disposed along the length of the second space 14, and extends in the height direction of the second space 14. In the present embodiment, the baffle 18 preferably extends along the entire length and height directions of the second space 14, but this is not limiting.

Figure 6:
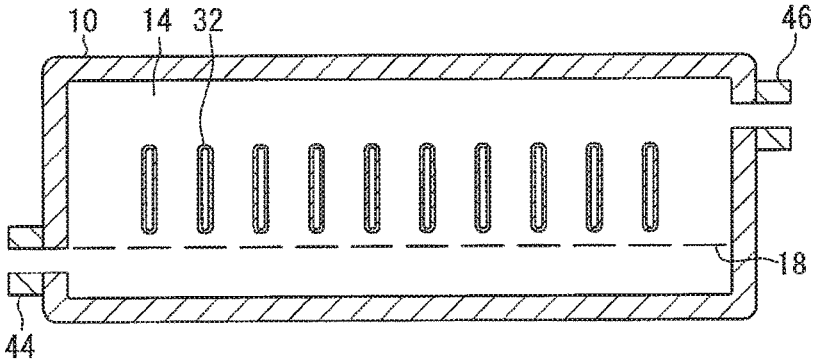
FIG. 6 is a cross section view of a multifluid heat exchanger.

As shown in FIG. 6, the baffle 18 is provided with openings corresponding to the gaps between adjacent ones of the fluid conduits 32. In other words, the baffle 18 directs the second internal fluid to flow between the fluid conduits 32. As a result, the second internal fluid flows smoothly inside the second space 14, and chaotic or otherwise undesirable flow patterns (such as dead spots) may be avoided.

While FIG. 6 shows a single baffle 18 positioned closer to the third fluid port 44, other arrangements are contemplated. For example, the baffle 18 may be positioned closer toward the fourth fluid port 46 instead, or a baffle 18 may be provided on either side of the fluid conduits 32. Additionally, other types of baffles are contemplated, as long as these baffles promote desirable flow patterns within the second space 14. The specific shape and dimensions of the baffle 18 may be designed as appropriate based on the desired flow rate and flow patterns of the second internal fluid.

Third Embodiment

Figure 7:
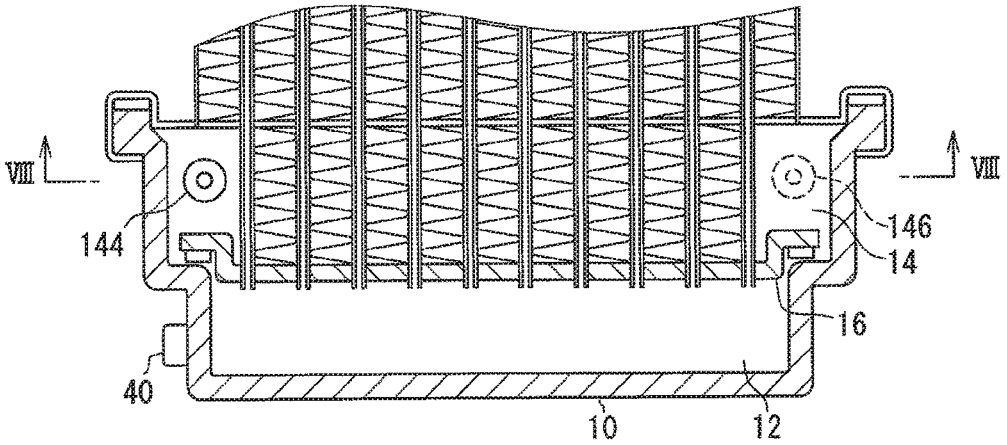
FIG. 7 is a sectional view showing fluid ports of a multifluid heat exchanger.

A third embodiment of the present disclosure will be described with reference to FIGS. 7 and 8. Explanations with respect to elements which are identical or otherwise corresponding to those of the previous embodiments will be omitted for brevity.

In the above described embodiments, the third fluid port 44 and the fourth fluid port 46 are illustrated as being disposed on opposite surfaces of the second space 14 in the length direction. In contrast, in the present embodiment, the second space 14 is provided with a third fluid port 144 and a fourth fluid port 146 which are disposed on opposite surfaces of the second space 14 in the width direction. As shown in FIG. 7, the third fluid port 144 is disposed on a front side of the second space 14, while the fourth fluid port 146 is disposed on a rear side of the second space 14 (the terms "front" and "rear" here are relative to the view of FIG. 7).

Figure 8:
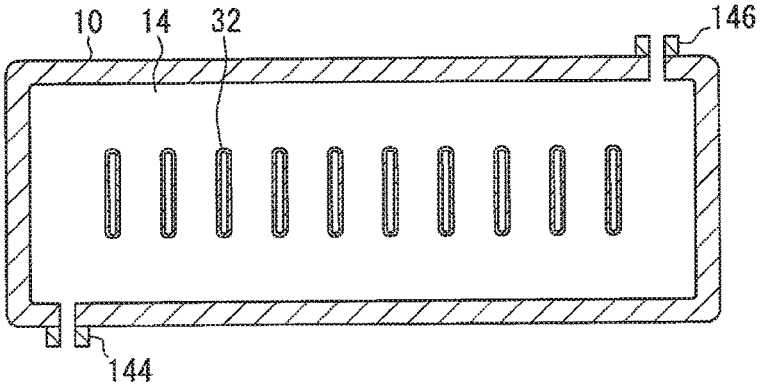
FIG. 8 is a cross section view along line VIII of FIG. 7, and shows fluid ports of a multifluid heat exchanger.

In the present embodiment as well, as shown in FIG. 8, the third fluid port 144 is offset from the fourth fluid port 146 along the width direction of the second space 14. That is, the third fluid port 144 is closer toward one side in the width direction, while the fourth fluid port 146 is closer toward the opposite side in the width direction. As a result, the second internal fluid in the second space 14 flows past the fluid conduits 32 when passing through the second space 14. Accordingly, the second internal fluid also flows past the fins 34 (not shown in FIG. 8 for clarity) disposed between the fluid conduits 32. As described previously, the fins 34 are preferably oriented to extend along the width direction. Accordingly, in this example as well, the second internal fluid flows along the fins 34 when flowing past the fluid conduits 32.

As a result of the above described configuration, heat may be efficiently exchanged between the first internal fluid and the second internal fluid.

Fourth Embodiment

A fourth embodiment of the present disclosure will be described with reference to FIGS. 9 and 10. Explanations with respect to elements which are identical or otherwise corresponding to those of the previous embodiments will be omitted for brevity.

In the present embodiment, the second space 14 is provided with a third fluid port 244 and a fourth fluid port 246 which are offset from each other in the height direction of the first tank 10. As shown in FIG. 9, the third fluid port 244 is disposed lower than the fourth fluid port 246. As a result, the internal second fluid in the second space 14 is forced to go through an elevation change while flowing through the second space 14.

In this case, the fins 34 are preferably not provided within the second space 14, so as to not impede the upward/downward flow of the second internal fluid. Instead, vertically aligned fins (not illustrated) which extend the height direction may be provided, or no fins may be provided.

As with the second embodiment, a baffle (not illustrated) may be disposed within the second space 14 to promote desirable flow of the second internal fluid within the second space 14.

Figure 9:
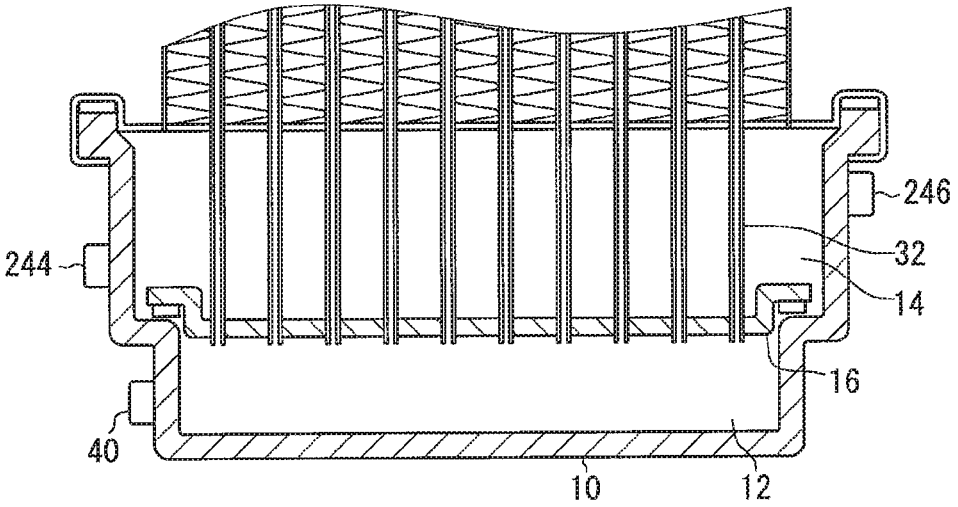
FIG. 9 is a sectional view showing fluid ports of a multifluid heat exchanger.
Figure 10:
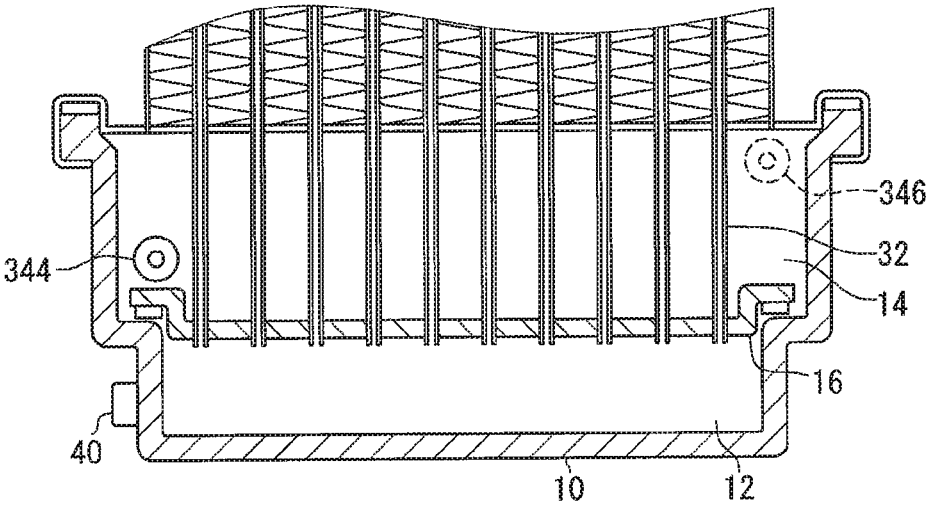
FIG. 10 is a sectional view showing fluid ports of a multifluid heat exchanger.

In FIG. 9, the third fluid port 244 and the fourth fluid port 246 are depicted as being disposed on opposite surfaces of the second space 14 in the length direction. However, as shown in FIG. 10, a third fluid port 344 and a fourth fluid port 346 may be disposed on opposite surfaces of the second space 14 in the width direction instead, while still being offset from each other in the height direction of the first tank 10.

According to the present embodiment, heat exchange between the first internal fluid and the second internal fluid is further promoted by ensuring that the second internal fluid flows along the fluid conduits 32 in the height direction as well, thus including an additional vector for heat exchange.

Other Embodiments

The present disclosure is described with reference to the above embodiments, but these embodiments are not intended to be limiting. A variety of modifications which do not depart from the gist of the present disclosure are contemplated.

The above described embodiments may be combined in any manner which does not present any particular problem in the combination. For example, the baffle described with respect to the second embodiment may be applied to any of the other embodiments, with the shape of the baffle being designed as appropriate with respect to the relative positions of the third and fourth fluid ports. As another example, the third and fourth fluid ports may be offset from each other in both the width and height directions (i.e., combining the first embodiment and the fourth embodiment), or in both the length and height direction (i.e., combining the third embodiment and the fourth embodiment).

The locations of the first fluid port and the second fluid port as depicted in the drawings are not intended to be limiting. The first fluid port may be disposed on any surface of the first space. Similarly, the second fluid port may be disposed on any surface of the second tank.

Similarly, the locations of the third fluid port and the fourth fluid port are not intended to be limiting. For example, while it is preferable to have the third and fourth fluid ports be offset from each other in the width direction, the height direction, or both the width direction and the height direction, this is not a limiting requirement. Instead, for example, the third and fourth fluid ports may be coaxial along the length direction, as long as the third and fourth fluid ports are disposed on opposite surfaces of the second space.

The invention claimed is:

1. A multifluid heat exchanger, comprising:
- a first tank;
- a second tank;
- a plurality of fluid conduits; and
- a partition disposed inside the first tank that divides an internal space of the first tank into a first space and a second space to separate the first space from the second space in a liquid tight manner, wherein
- the plurality of fluid conduits fluidly pass through the second space to fluidly connect the first space to the second tank, wherein
- the multifluid heat exchanger further comprises a baffle disposed in the second space, the baffle configured to regulate a flow of a fluid in the second space.

2. The multifluid heat exchanger of claim 1, wherein
- the first space of the first tank is configured to carry a first internal fluid which flows through the first space, the plurality of fluid conduits, and the second tank, and
- the second space of the first tank is configured to carry a second internal fluid which flows through the second space while exchanging heat to or from the first internal fluid flowing through the plurality of fluid conduits.

3. The multifluid heat exchanger of claim 1, wherein
- a first fluid port provided on the first tank to be in fluid communication with the first space;
- a second fluid port provided on the second tank;
- a third fluid port provided on the first tank to be in fluid communication with the second space; and
- a fourth fluid port provided on the first tank to be in fluid communication with the second space, the fourth fluid port being disposed on an opposite surface of the first tank as the third fluid port.

4. The multifluid heat exchanger of claim 1, wherein a plurality of fins are disposed between adjacent ones of the plurality of fluid conduits at a portion of the plurality of fluid conduits passing through the second space.

5. The multifluid heat exchanger for claim 4, wherein the plurality of fins are oriented to extend in a direction orthogonal to an extension direction of the plurality of fluid conduits.

6. The multifluid heat exchanger of claim 3, wherein the third fluid port is offset from the fourth fluid port along a width direction of the second space, the width direction being orthogonal to an extension direction of the plurality of fluid conduits.

7. The multifluid heat exchanger of claim 6, wherein the plurality of fluid conduits are disposed between the third fluid port and the fourth fluid port in the width direction of the second space.

8. The multifluid heat exchanger of claim 3, wherein the third fluid port is offset from the fourth fluid port along a height direction of the second space, the height direction substantially coinciding with an extension direction of the plurality of fluid conduits.

9. The multifluid heat exchanger of claim 8, wherein a plurality of fins are disposed between adjacent ones of the plurality of fluid conduits at a portion of the plurality of fluid conduits passing through the second space.

10. The multifluid heat exchanger for claim 9, wherein the plurality of fins are oriented to extend in the height direction.

11. The multifluid heat exchanger of claim 1, wherein a gasket member is disposed between the partition and a wall portion of the first tank.

12. The multifluid heat exchanger of claim 1, wherein the plurality of fluid conduits are held in a core, the core being between the first tank and the second tank, and a gasket member is disposed between the first tank and the core.

13. The multifluid heat exchanger of claim 12, wherein the first tank is crimped to the core.

14. The multifluid heat exchanger of claim 1, wherein the baffle extends along a length direction of the second space, the length direction being orthogonal to an extension direction of the plurality of fluid conduits.

15. The multifluid heat exchanger of claim 1, wherein the baffle is provided with openings corresponds to gaps between adjacent ones of the plurality of fluid conduits.

16. A multifluid heat exchanger, comprising:

a first tank;

a second tank;

a core including a plurality of fluid conduits connecting the first tank to the second tank, and a plurality of fins disposed between adjacent ones of the plurality of fluid conduits;

a partition disposed inside the first tank that divides an internal space of the first tank into a first space and a second space, the first space being separated from the second space in a liquid tight manner by the partition, the second space being between the first space and the core;

a first fluid port provided on the first tank to be in fluid communication with the first space;

a second fluid port provided on the second tank;

a third fluid port provided on the first tank to be in fluid communication with the second space; and a fourth fluid port provided on the first tank to be in fluid communication with the second space, the fourth fluid port being disposed on an opposite surface of the first tank as the third fluid port, wherein the plurality of fluid conduits extend through the second space and through the partition to connect to first space with the second tank, wherein the multifluid heat exchanger further comprises a baffle disposed in the second space, the baffle configured to regulate a flow of a fluid in the second space.

17. The multifluid heat exchanger of claim 16, wherein the third fluid port is offset from the fourth fluid port along a width or height direction of the second space, the width direction being orthogonal to an extension direction of the plurality of fluid conduits, the height direction substantially coinciding with an extension direction of the plurality of fluid conduits.

* * * * *